US011685171B2

(12) United States Patent
Ishimoto et al.

(10) Patent No.: US 11,685,171 B2
(45) Date of Patent: Jun. 27, 2023

(54) TAPE SUPPLYING DEVICE AND TAPE PRINTING SYSTEM

(71) Applicant: Seiko Epson Corporation, Tokyo (JP)

(72) Inventors: Akio Ishimoto, Nagano (JP); Taishi Sasaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/720,608

(22) Filed: Dec. 19, 2019

(65) Prior Publication Data

US 2020/0207115 A1 Jul. 2, 2020

(30) Foreign Application Priority Data

Dec. 26, 2018 (JP) ..... JP2018-243224

(51) Int. Cl.
*B41J 3/407* (2006.01)
*B41J 15/04* (2006.01)

(52) U.S. Cl.
CPC ..... *B41J 3/4075* (2013.01); *B41J 15/044* (2013.01)

(58) Field of Classification Search
None
See application file for complete search history.

(56) References Cited

U.S. PATENT DOCUMENTS 3,540,671 A * 11/1970 Moehle ..... B65H 23/24 242/421.5
6,168,324 B1 * 1/2001 Lever ..... B41J 3/42 400/120.05
2006/0191152 A1 * 8/2006 Huang ..... B65H 35/0033 33/733
2013/0216292 A1 * 8/2013 Yokoyama ..... B41J 15/04 400/613
2013/0255459 A1 * 10/2013 Nakajima ..... B65H 35/006 83/109
2015/0251469 A1 * 9/2015 Kasuga ..... B41J 29/38 347/110

FOREIGN PATENT DOCUMENTS

JP S68752 Y1 7/1931
JP H08-039878 A 2/1996
JP 2004058552 A 2/2004
JP 2011046042 A 3/2011
JP 5924749 B1 * 5/2016

OTHER PUBLICATIONS

Machine Translation of KUDU (Year: 2016).*
Office Action for JP Patent Application No. JP2018243224, dated Oct. 25, 2022, 6 pages of Office Action.

* cited by examiner

*Primary Examiner* — Matthew G Marini
(74) *Attorney, Agent, or Firm* — Chip Law Group

(57) ABSTRACT

Disclosed is a tape supplying device that supplies a printing tape fed out from a tape roll having the printing tape wound therein to a tape printing device, the tape supplying device including: a roll supporting part that supports the tape roll in a posture in which a rotation axis of the tape roll crosses a mounting surface on which the tape printing device and the tape supplying device are mounted, wherein the tape supplying device supplies the printing tape to the tape printing device in a state in which the tape supplying device is not installed on the tape printing device.

2 Claims, 8 Drawing Sheets

TAPE SUPPLYING DEVICE AND TAPE PRINTING SYSTEM

CROSS REFERENCES TO RELATED APPLICATIONS

The entire disclosure of Japanese Patent Application No. 2018-243224, filed Dec. 26, 2018 is expressly incorporated by reference herein.

BACKGROUND

1. Technical Field

This application relates to a tape supplying device and a tape printing system that supply a printing tape to a tape printing device.

2. Related Art

Conventionally, a rendering tape cartridge that is placed on tape cartridge supporting arms protruding from a rendering tape printing machine has been known as disclosed in JP-A-08-039878.

SUMMARY

Since a conventional rendering tape cartridge is configured to be placed on tape cartridge supporting arms protruding from a rendering tape printing machine, the winding diameter of a tape roll capable of being placed on the tape cartridge supporting arms is restricted, which puts a limit on the elongation of a tape.

According to an aspect of the disclosed embodiments, there is provided a tape supplying device that supplies a printing tape from a tape roll having the printing tape wound therein to a tape printing device, the tape supplying device including: a roll supporting part that supports the tape roll in a posture in which a rotation axis of the tape roll crosses a mounting surface on which the tape printing device and the tape supplying device are mounted, wherein the tape supplying device supplies the printing tape to the tape printing device in a state in which the tape supplying device is not installed on the tape printing device.

According to another aspect of the disclosed embodiments, there is provided a tape printing system including: a tape printing device; and a tape supplying device that supplies a printing tape from a tape roll having the printing tape wound therein to a tape printing device, wherein the tape supplying device includes a roll supporting part that supports the tape roll in a posture in which a rotation axis of the tape roll crosses a mounting surface on which the tape printing device and the tape supplying device are mounted, and supplies the printing tape to the tape printing device in a state in which the tape supplying device is not installed on the tape printing device.

DESCRIPTION OF EXEMPLARY EMBODIMENTS

Figure 1:
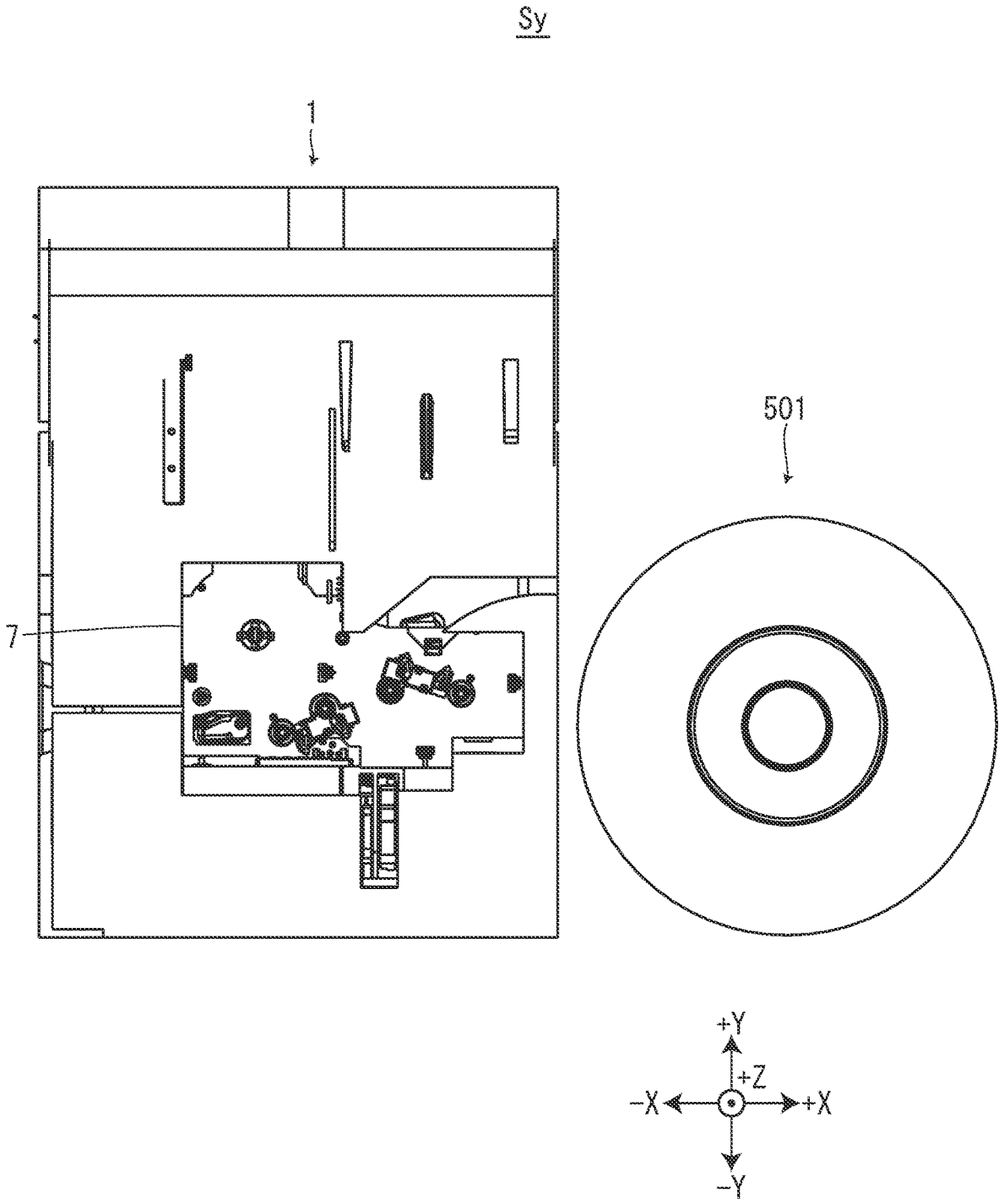
FIG. 1 is a view of a tape supplying device and a tape printing device when seen from an installation direction.
Figure 4:
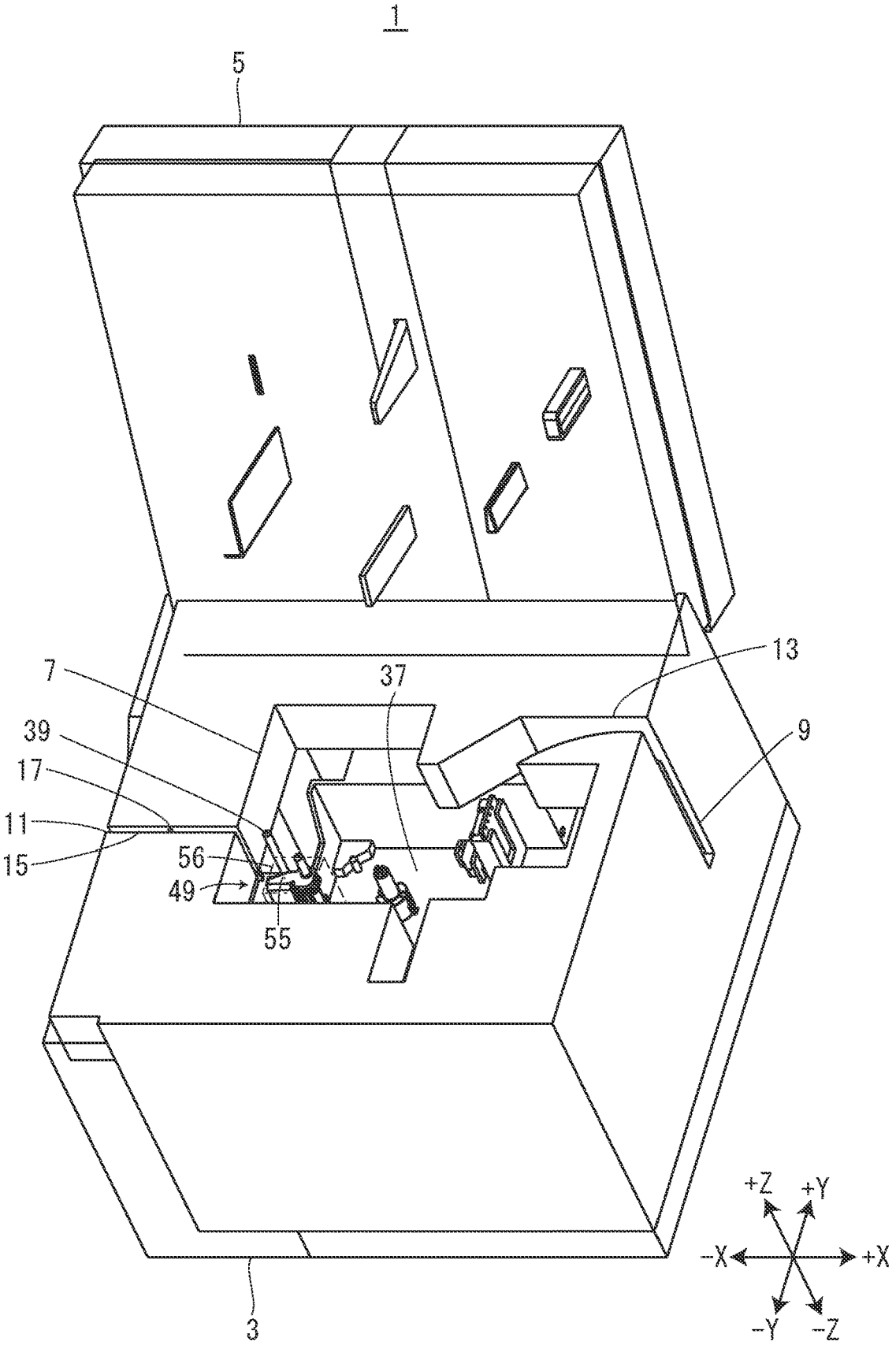
FIG. 4 is a perspective view of the tape printing device.

Directions in the following drawings will be defined. The vertical direction of a tape printing device 1 and a tape supplying device 501 is defined as a Z direction, a longitudinal direction orthogonal to the Z direction is defined as an X direction, and a cross direction orthogonal to the Z direction and the X direction is defined as a Y direction. In the Z direction, a lower direction or a gravity direction is defined as a −Z direction, and an upper direction is defined as a +Z direction. In the Y direction, one direction is defined as a +Y direction, and a direction opposite to the one direction is defined as a −Y direction. In FIG. 4, the rotational shaft side of an installation-part cover 5 is defined as the +Y direction. In the X direction, one direction is defined as a +X direction, and a direction opposite to the one direction is defined as a −X direction. In FIG. 1, a right side in plan view is defined as the +X direction. Note that these directions are given only for the convenience of descriptions and do not intend to limit the following embodiments at all as a matter of course.

(Overview of Printing System)

The overview of a tape printing system Sy will be described with reference to FIGS. 1 to 3. The tape printing system Sy includes the tape printing device 1 and the tape supplying device 501. In the tape printing device 1, a tape cartridge 101 and a ribbon cartridge 201 are alternatively installed.

Figure 2:
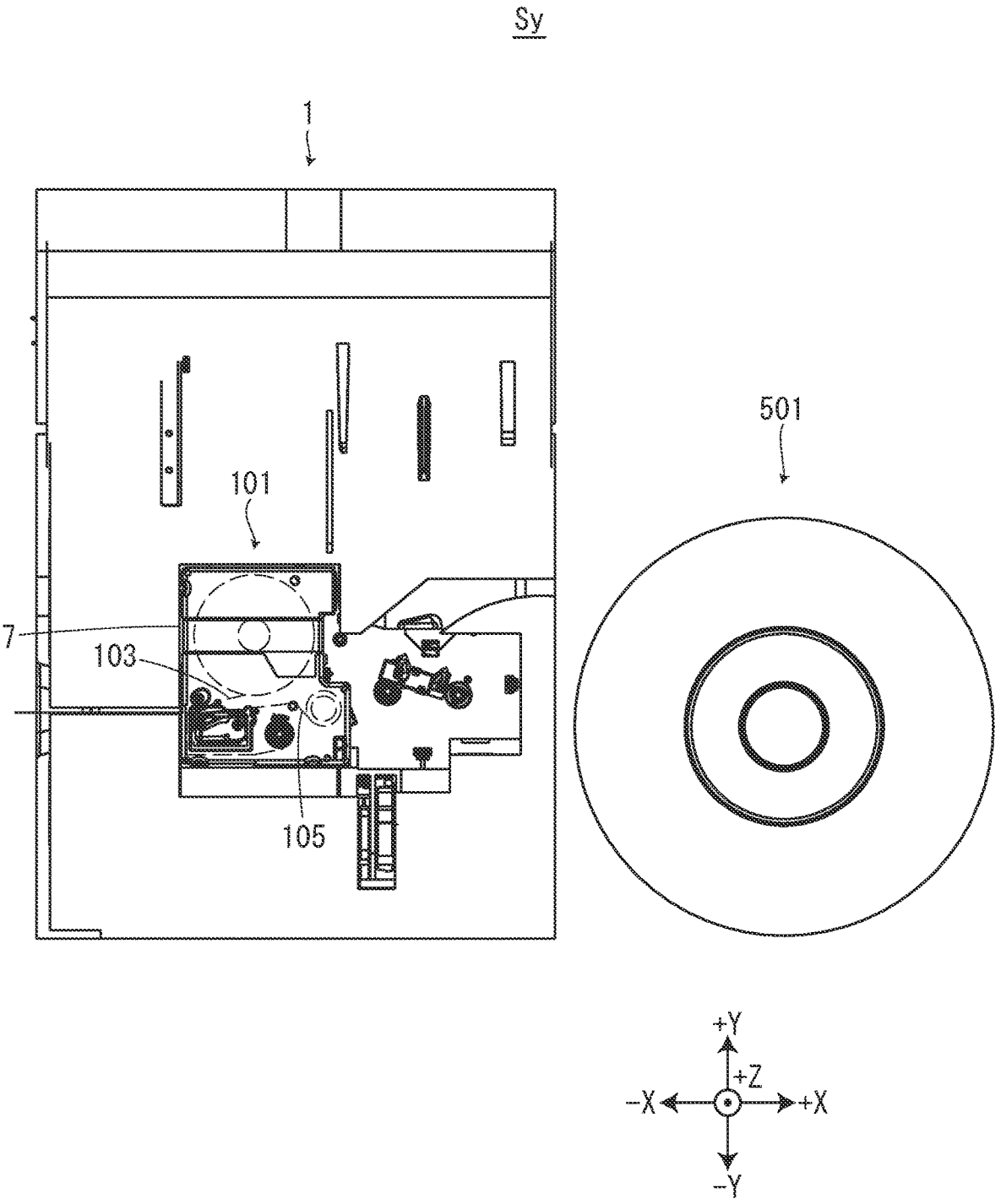
FIG. 2 is a view of the tape printing device in a state in which a tape cartridge is installed and the tape supplying device in a state in which a second printing tape is not supplied to the tape printing device when seen from the installation direction.

As shown in FIG. 2, a first printing tape 103 and a first ink ribbon 105 are accommodated in the tape cartridge 101. In a state in which the tape cartridge 101 is installed in a cartridge installation part 7, the tape printing device 1 performs printing on the first printing tape 103, while feeding the first printing tape 103 and the first ink ribbon 105 accommodated in the tape cartridge 101. Note that the tape supplying device 501 is not used in a state in which the tape cartridge 101 is installed in the cartridge installation part 7.

Figure 3:
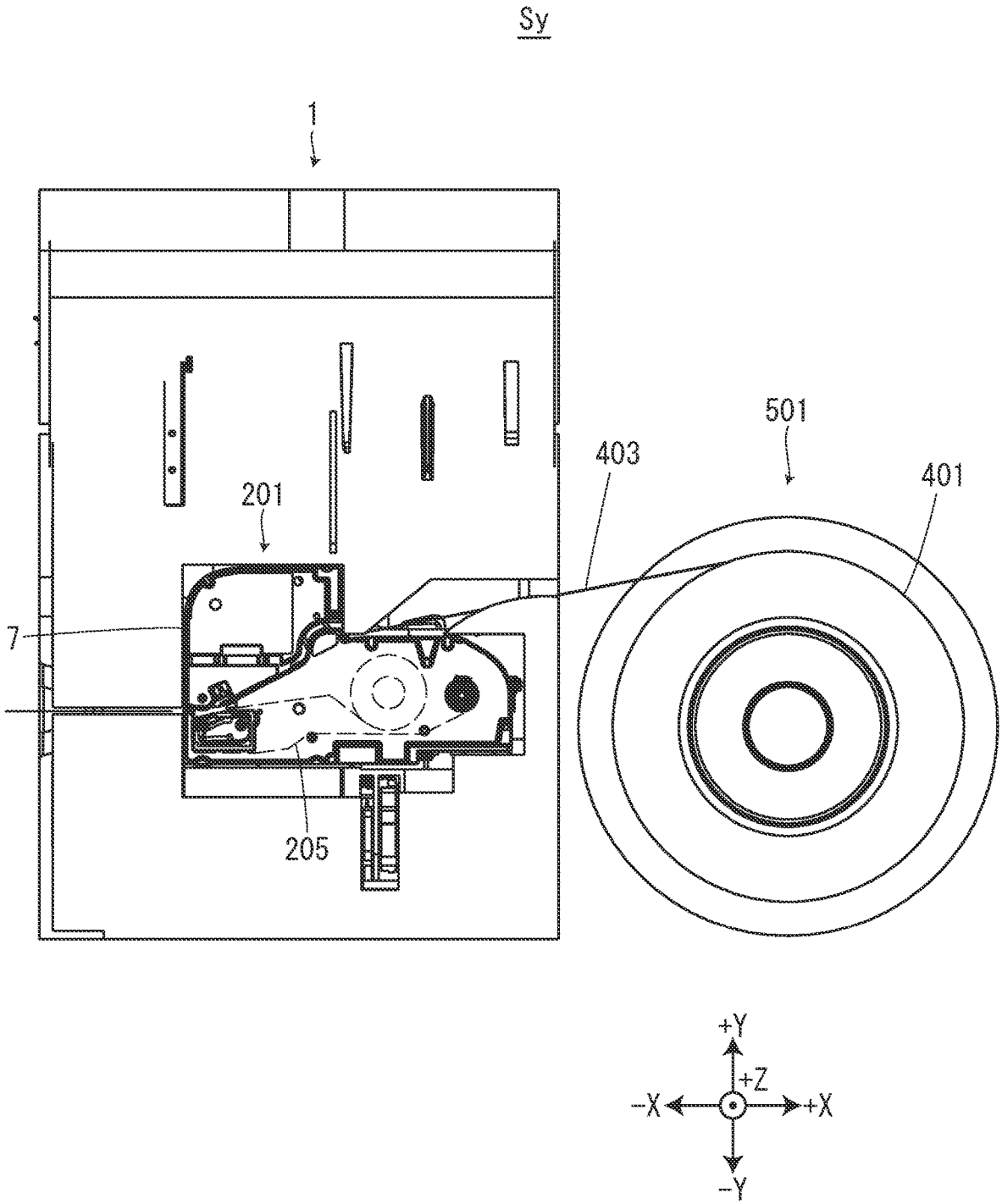
FIG. 3 is a view of the tape printing device in a state in which a ribbon cartridge is installed and the tape supplying device in a state in which the second printing tape is supplied to the tape printing device when seen from the installation direction.

As shown in FIG. 3, a second ink ribbon 205 is accommodated in the ribbon cartridge 201. In a state in which the ribbon cartridge 201 is installed in the cartridge installation part 7, a second printing tape 403 that has been fed out from a tape roll 401 set in the tape supplying device 501 is introduced into the tape printing device 1. The tape printing device 1 performs printing on the second printing tape 403, while feeding the introduced second printing tape 403 and the second ink ribbon 205 accommodated in the ribbon cartridge 201.

Note that the length of the second printing tape 403 in the tape roll 401 that has not been used and the length of the second ink ribbon 205 accommodated in the ribbon cartridge 201 that has not been used are not particularly limited but are longer than the length of the first printing tape 103 and the length of the first ink ribbon 105 accommodated in the tape cartridge 101 that has not been used, respectively, in the present embodiment. Therefore, the ribbon cartridge 201 is installed, for example, when large amounts of labels are created at once.

(Tape Printing Device)

The tape printing device 1 will be described with reference to FIG. 4. The tape printing device 1 includes a device case 3, the installation-part cover 5, and the cartridge installation part 7. The device case 3 is formed into a substantially cuboid shape. The device case 3 has a device-side tape introduction port 9 for the second printing tape 403 that has been fed out from the tape roll 401 on its +X-side surface, and has a device-side tape ejection port 11 shared between the tape cartridge 101 and the ribbon cartridge 201 on its −X-side surface. The device-side tape introduction port 9 introduces the second printing tape 403 from the outside of the device case 3 into the inside of the device case 3. The device-side tape ejection port 11 ejects the introduced second printing tape 403 to the outside of the device case 3. Further, the device-side tape ejection port 11 ejects the first printing tape 103 that has been delivered from the tape cartridge 101 installed in the cartridge installation part 7 to the outside of the device case 3. Each of the device-side tape introduction port 9 and the device-side tape ejection port 11 is formed into a slit shape extending in the Z direction. Further, in a tape feeding path inside the tape printing device 1, a direction in which the second printing tape 403 is directed from the device-side tape introduction port 9 to the device-side tape ejection port 11 is defined as a downstream, and a direction opposite to the above direction is defined as an upstream.

The device case 3 has a tape introduction path 13 that connects the device-side tape introduction port 9 and the cartridge installation part 7 to each other. Further, the device case 3 has a tape ejection path 15 that connects the cartridge installation part 7 and the device-side tape ejection port 11 to each other. Each of the tape introduction path 13 and the tape ejection path 15 is formed into a groove shape having an opening on the +Z side. The tape ejection path 15 has a cutter 17. The cutter 17 cuts off the first printing tape 103 or the second printing tape 403 in the tape ejection path 15.

An installation-part cover 5 opens/closes the cartridge installation part 7. The installation-part cover 5 has a keyboard and a display on its outside surface although not shown in the figure. The keyboard receives input operations to input printing information such as character strings and issue various instructions to perform printing or the like. The display displays various information besides printing information input via the keyboard. The display has a rotation shaft serving as a hinge and is configured to be accommodatable in the installation-part cover 5. When the display is accommodated in the installation-part cover 5, the display surface of the display faces the keyboard. When the keyboard receives an input operation to perform printing, the tape printing device 1 performs printing processing on the basis of printing information input via the keyboard. Note that the tape printing device 1 may be configured to include input display means such as a touch panel type display instead of the keyboard and the display. Further, the tape printing device 1 may be configured to perform printing processing on the basis of printing data and a command received from an external device such as a personal computer and a smart phone. In other words, the tape printing system Sy in which the tape printing device 1, an external device serving as an operation terminal, and the tape supplying device 501 are combined together may be configured. When the tape printing device 1 is configured to be connectable to such an external device, the keyboard and the display may or may not be provided in the tape printing device 1.

The cartridge installation part 7 is formed into a concave shape having an opening on the +Z side. The cartridge installation part 7 has, on its bottom surface, i.e., an installation bottom surface 37 that is a −Z-side surface, a platen shaft 39 and a head part 49 provided to protrude to the +Z side.

When the tape cartridge 101 or the ribbon cartridge 201 is installed in the cartridge installation part 7, the platen shaft 39 is inserted into a first platen roller 109 or a second platen roller 203 that will be described later to guide the installation of the tape cartridge 101 or the ribbon cartridge 201. Note that the installation direction of the tape cartridge 101 and the ribbon cartridge 201 will be simply defined as an "installation direction" below, and the installation direction is parallel to a direction in which the platen shaft 39 extends, i.e., the Z direction. Further, an opposite direction to the installation direction indicates the +Z side, and the installation direction indicates the −Z side.

The head part 49 is positioned on the −Y side of the platen shaft 39. The head part 49 includes a printing head 55 and a head cover 56 that covers at least the +X side, the −Y side, and the opposite direction to the installation direction of the printing head 55. The printing head 55 is a thermal head including a heat generation element. The head cover 56 is formed into a substantially rectangular shape when seen from the installation direction. When the tape cartridge 101 or the ribbon cartridge 201 is installed in the cartridge installation part 7, the head cover 56 guides the installation of the tape cartridge 101 or the ribbon cartridge 201 together with the platen shaft 39. In FIG. 4, the head cover 56 is virtually indicated by two-dot chain lines in order to show the printing head 55.

(Ribbon Cartridge)

Figure 5:
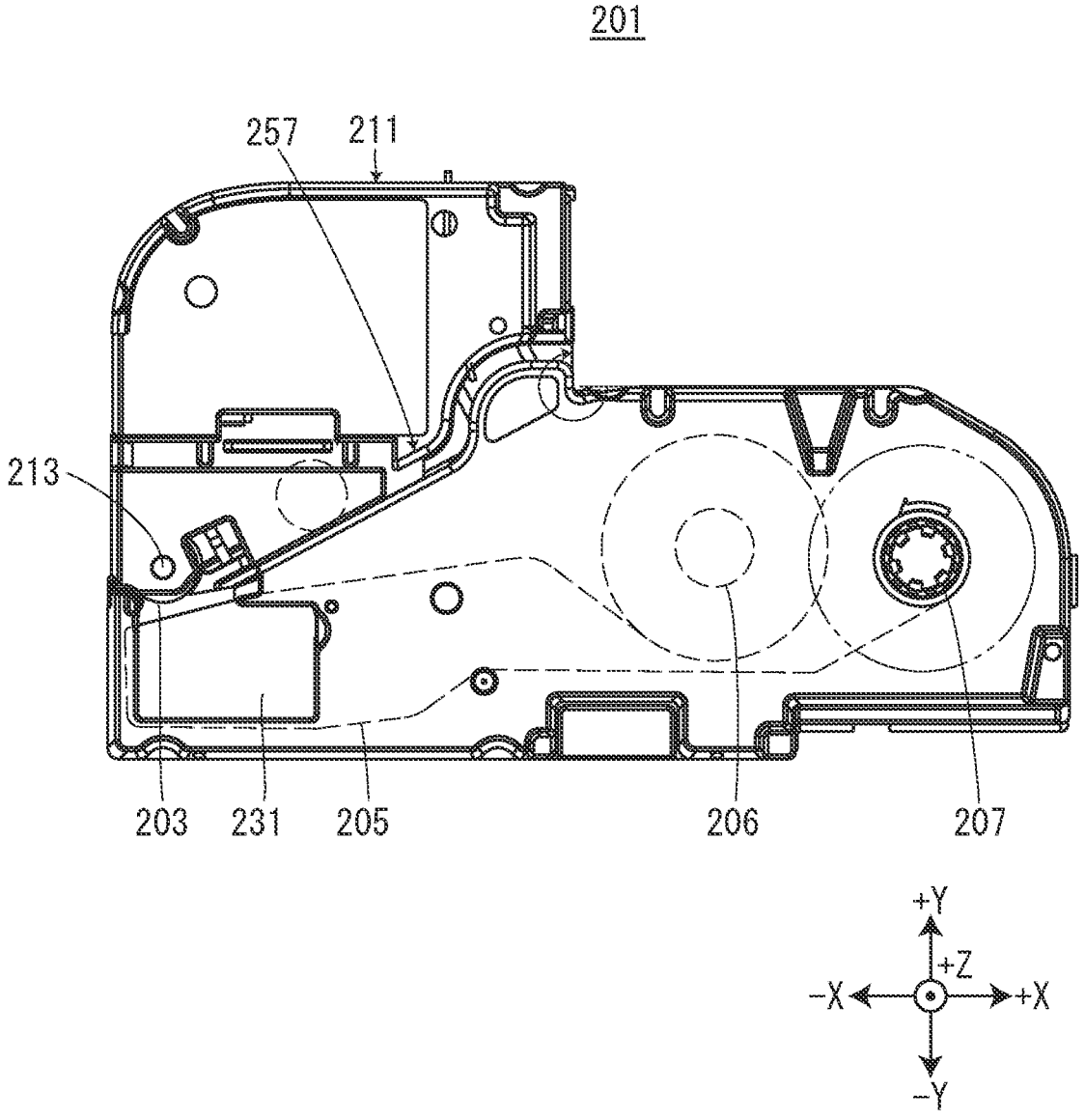
FIG. 5 is a view of the ribbon cartridge when seen from the installation direction.

The ribbon cartridge 201 will be described with reference to FIG. 5. The ribbon cartridge 201 includes a second platen roller 203, a second feeding core 206, a second winding core 207, and a second cartridge case 211 that accommodates the second platen roller 203, the second feeding core 206, and the second winding core 207.

The second platen roller 203 has a second platen shaft insertion hole 213 penetrating in the installation direction. The second ink ribbon 205 is wound on the second feeding core 206. The second ink ribbon 205 that has been fed out from the second feeding core 206 is wound up by the second winding core 207. The second cartridge case 211 has a second head insertion hole 231 provided to penetrate in the insertion direction. Further, the second cartridge case 211 has a second tape path 257 formed into a groove shape having an opening in the opposite direction to the installation direction. The second printing tape 403 is set in the second tape path 257 in advance before the ribbon cartridge 201 is installed in the cartridge installation part 7. That is, the ribbon cartridge 201 is installed in the cartridge installation part 7 with the second printing tape 403 set in the second tape path 257. In a state in which the ribbon cartridge 201 is installed in the cartridge installation part 7, the second printing tape 403 that has been introduced from the device-side tape introduction port 9 is fed to the device-side tape ejection port 11 via the second tape path 257.

When the ribbon cartridge 201 is attached to and detached from the cartridge installation part 7, the second head insertion hole 231 and the second platen shaft insertion hole 213 position the ribbon cartridge 201 and guide the attachment and detachment of the ribbon cartridge 201. When the installation-part cover 5 is closed after the installation of the ribbon cartridge 201 in the cartridge installation part 7, the printing head 55 is caused to move to the platen shaft 39 by a head movement mechanism not shown. Thus, the second printing tape 403 and the second ink ribbon 205 are sandwiched between the printing head 55 and the second platen roller 203. By heating the printing head 55 while feeding the second printing tape 403 and the second ink ribbon 205 through the rotation of the second platen roller 203, the tape printing device 1 prints printing information input via the keyboard or the like on the second printing tape 403.

(Tape Cartridge)

Figure 6:
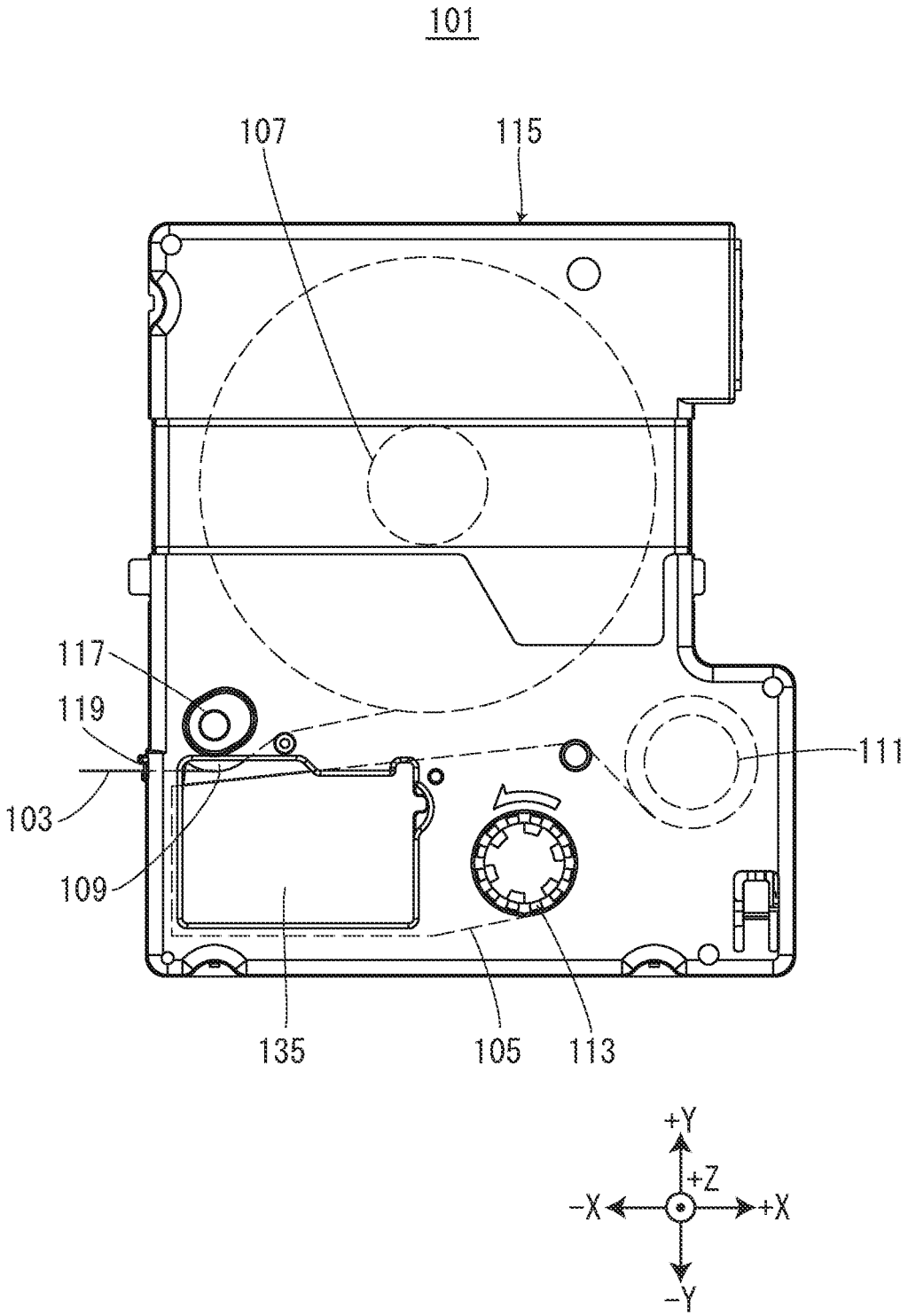
FIG. 6 is a view of the tape cartridge when seen from the installation direction.

The tape cartridge 101 will be described with reference to FIG. 6. The tape cartridge 101 includes a tape core 107, a first platen roller 109, a first feeding core 111, a first winding core 113, and a first cartridge case 115 that accommodates the tape core 107, the first platen roller 109, the first feeding core 111, and the first winding core 113.

The first printing tape 103 is wound on the tape core 107. The first printing tape 103 that has been fed out from the tape core 107 is delivered to the outside of the first cartridge case 115 from a tape delivery port 119. The first platen roller 109 has a first platen shaft insertion hole 117 penetrating in the installation direction. The first ink ribbon 105 is wound on the first feeding core 111. The first ink ribbon 105 that has been fed out from the first feeding core 111 is wound up by the first winding core 113. The first cartridge case 115 has a first head insertion hole 135 provided to penetrate in the installation direction.

When the tape cartridge 101 is installed in the cartridge installation part 7, the first head insertion hole 135 and the first platen shaft insertion hole 117 position the tape cartridge 101 and guide the attachment and detachment of the tape cartridge 101. When the installation-part cover 5 is closed after the installation of the tape cartridge 101 in the cartridge installation part 7, the printing head 55 is caused to move to the platen shaft 39 by the head movement mechanism. Thus, the first printing tape 103 and the first ink ribbon 105 are sandwiched between the printing head 55 and the first platen roller 109. By heating the printing head 55 while feeding the first printing tape 103 and the first ink ribbon 105 through the rotation of the first platen roller 109, the tape printing device 1 prints printing information input via the keyboard or the like on the first printing tape 103.

(Tape Supplying Device)

Figure 7:
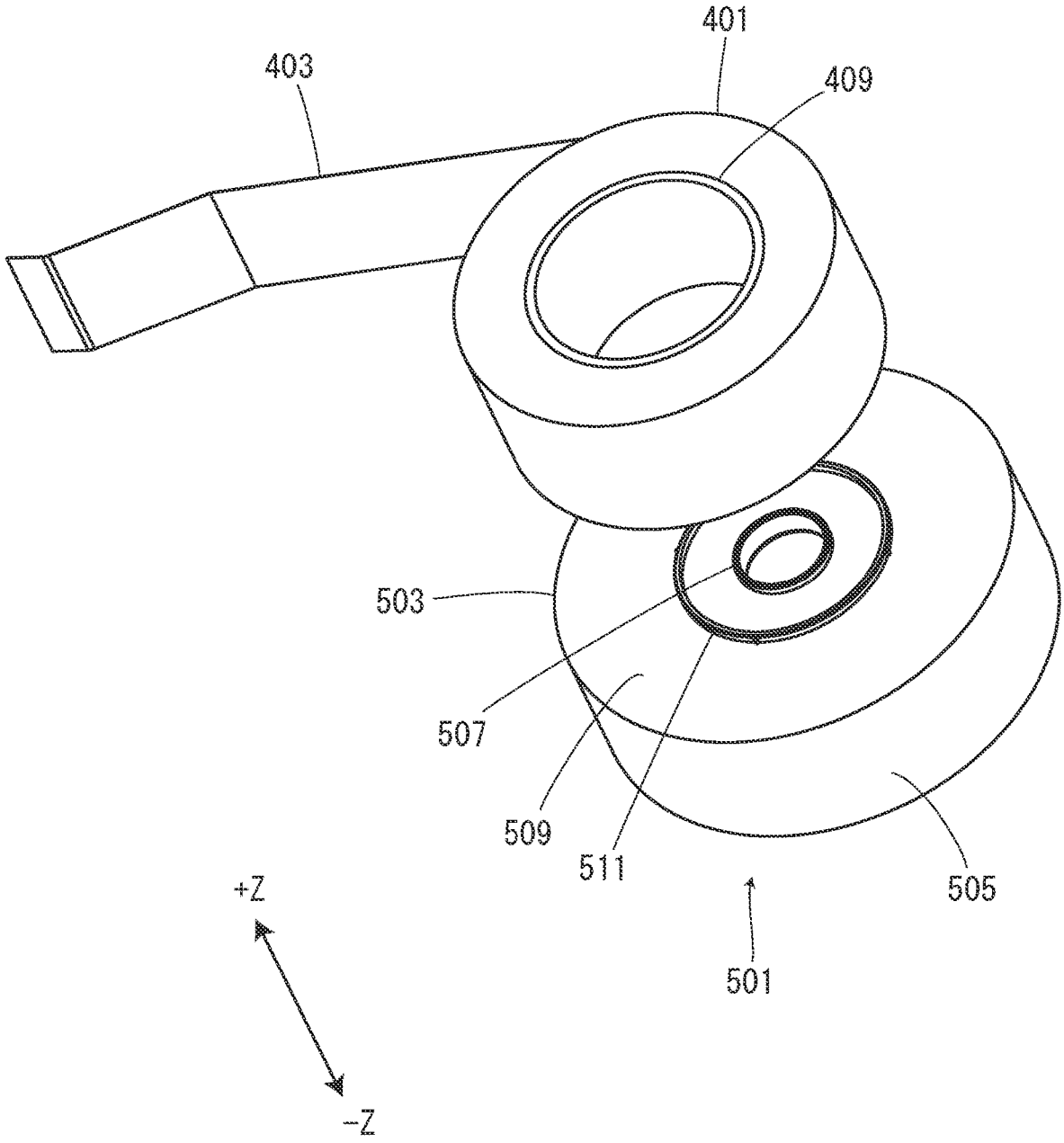
FIG. 7 is a perspective view of the tape supplying device and a tape roll.
Figure 8:
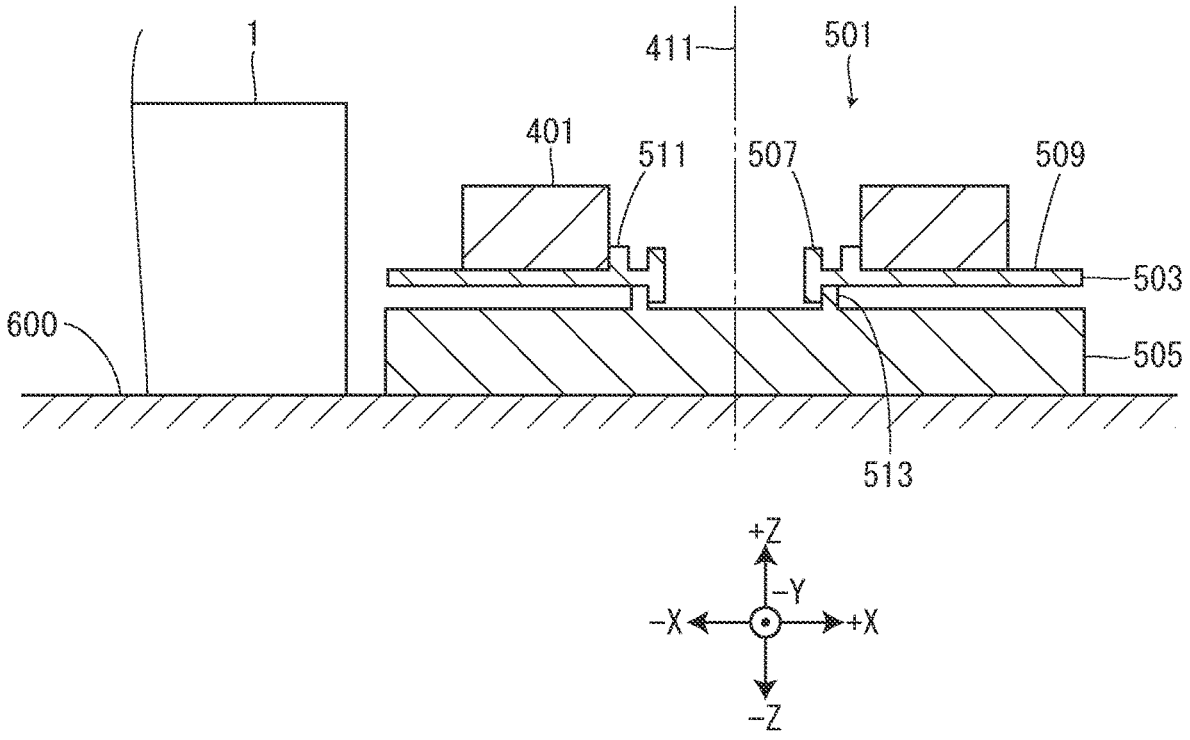
FIG. 8 is a schematic cross-sectional view of the tape supplying device and the tape roll.

The tape supplying device 501 will be described with reference to FIGS. 7 and 8. The tape supplying device 501 rotatably supports the tape roll 401 and supplies the second printing tape 403 from the tape roll 401 to the tape printing device 1. Note that the tape roll 401 is one in which the second printing tape 403 is wound on a roll core 409. The tape supplying device 501 is mounted on a mounting surface 600 that is, for example, the upper surface of a desk together with the tape printing device 1. Note that the mounting surface 600 is a surface parallel to an XY plane in the present embodiment. The tape supplying device 501 includes a roll supporting part 503 and a pedestal part 505. Further, the height in the Z direction of the tape supplying device 501 is set at a height at which the second printing tape 403 is smoothly supplied to the device-side tape introduction port 9 of the tape printing device 1.

The roll supporting part 503 supports the tape roll 401. The roll supporting part 503 is positioned on the +Z side of the pedestal part 505 and provided to be rotatable with respect to the pedestal part 505. The roll supporting part 503 is formed into a substantially disc shape as a whole and includes a cylindrical part 507, a flange part 509, and a roll engagement part 511.

The cylindrical part 507 is provided at the substantially center of the roll supporting part 503 when seen from the +Z side, and formed into a substantially short cylindrical shape. The flange part 509 is provided to expand in a flange shape outside in a radial direction from the substantially intermediate part in the axial direction of the cylindrical part 507. On the flange part 509, the tape roll 401 is placed in a posture in which a roll rotation axis 411 that is the rotation axis of the tape roll 401 becomes parallel to the Z direction, i.e., in a posture in which the roll rotation axis 411 crosses the mounting surface 600. In other words, the tape roll 401 is placed on the flange part 509 in a posture in which one end surface of the tape roll 401 comes in contact with the +Z-side surface of the flange part 509.

The roll engagement part 511 substantially cylindrically protrudes from the +Z-side surface of the flange part 509, and is formed to be substantially concentric with the cylindrical part 507 outside the cylindrical part 507 when seen from the +Z side. The roll engagement part 511 is inserted into the roll core 409 of the tape roll 401 when the tape roll 401 is placed on the flange part 509. Thus, it is possible to position the tape roll 401 with respect to the roll supporting part 503 so that the roll rotation axis 411 and the rotation axis of the roll supporting part 503 become substantially coincident with each other. Note that the tape roll 401 may be of a coreless type in which the second printing tape 403 is wound to form the inner peripheral surface of the tape roll 401 without the use of the roll core 409. In this case, the roll engagement part 511 is inserted into the inside of the inner peripheral surface formed by the second printing tape 403.

The pedestal part 505 is formed into a substantially short cylindrical column shape and rotatably supports the roll supporting part 503. The pedestal part 505 has, on its +Z-side surface, a boss 513 positioned at the substantially center of the pedestal part 505 when seen from the +Z side and protruding to the +Z side in a cylindrical shape. When the roll supporting part 503 rotates, the boss 513 comes in contact with the outer peripheral surface of the cylindrical part 507 closer to the −Z side than the flange part 509. That is, the boss 513 guides the rotation of the roll supporting part 503. Note that the diameter of the pedestal part 505 is substantially equal to that of the roll supporting part 503. Further, space exists between the +Z-side surface of the pedestal part 505 and the −Z-side surface of the flange part 509. That is, since the roll supporting part 503 is rotatably supported by the boss 513, friction resistance caused between the roll supporting part 503 and the pedestal part 505 is reduced. Therefore, it is possible to smoothly rotate the roll supporting part 503.

Here, the tape supplying device 501 supplies the second printing tape 403 to the tape printing device 1 in a state in which the tape supplying device 501 is not installed on the tape printing device 1. Here, the state in which the tape supplying device 501 is not installed on the tape printing device 1 indicates a state in which the tape supplying device 501 is not secured to the tape printing device 1 by means of mechanical engagement, screwing, magnetic force, or the like, i.e., a state in which the tape supplying device 501 is movable. That is, a user is allowed to move the tape supplying device 501 and mount the same at any place with respect to the tape printing device 1. Therefore, even if the tape roll 401 has a winding diameter at which the tape roll 401 protrudes from the outer edge of the roll supporting part 503, it is possible to properly set the tape roll 401 on the roll supporting part 503 without interfering with the tape printing device 1 by mounting the tape supplying device 501 at a place distant from the tape printing device 1. Further, if the tape roll 401 is configured to be supported in a posture in which the roll rotation axis 411 becomes parallel to the mounting surface 600, the tape roll 401 interferes with the mounting surface 600 when the tape roll 401 has a large winding diameter. On the other hand, the tape roll 401 is supported in a posture in which the roll rotation axis 411 crosses the mounting surface 600 in the present embodiment. Therefore, it is possible to properly set the tape roll 401 on the roll supporting part 503 without interfering with the mounting surface 600 even if the tape roll 401 has a large winding diameter.

Meanwhile, as described above, the ribbon cartridge 201 is installed in the cartridge installation part 7 of the tape printing device 1 with the second printing tape 403 set in the second tape path 257 in advance. Further, as described above, the platen shaft 39 provided in the cartridge installation part 7 of the tape printing device 1 extends in the Z direction. That is, the platen shaft 39 extends in a direction crossing the mounting surface 600 like the roll rotation axis 411 of the tape roll 401. Therefore, when the user installs the ribbon cartridge 201 in which the second printing tape 403 is set in advance in the second tape path 257 in the cartridge installation part 7 after setting the tape roll 401 on the roll supporting part 503, it is possible to prevent the second printing tape 403 from twisting between the tape roll 401 and the ribbon cartridge 201. Accordingly, the second printing tape 403 easily follows the ribbon cartridge 201 installed in the cartridge installation part 7. As a result, the user is allowed to easily perform the operation of installing the ribbon cartridge 201 in the cartridge installation part 7.

When the second printing tape 403 is fed by the tape printing device 1 in a state in which the ribbon cartridge 201 is installed in the cartridge installation part 7, the second printing tape 403 is fed out from the tape roll 401 and the tape roll 401 rotates with the roll supporting part 503. At this time, if the tape roll 401 is configured to be supported in a posture in which the roll rotation axis 411 becomes parallel to the mounting surface 600, the tape roll 401 swings like a pendulum as the second printing tape 403 is fed, whereby the tension of the second printing tape 403 is likely to fluctuate. Therefore, there is a likelihood that the second printing tape 403 that has been introduced into the tape printing device 1 is pulled by the tape supplying device 501 to cause a printing failure. Further, if the tape roll 401 is configured to be supported in a posture in which the roll rotation axis 411 becomes parallel to the mounting surface 600, the second printing tape 403 easily sags between the tape roll 401 and the tape printing device 1. Therefore, there is a likelihood that the sagging part of the second printing tape 403 hinders the feeding of the second printing tape 403. On the other hand, in the present embodiment, the tape roll 401 is supported in a posture in which the roll rotation axis 411 crosses the mounting surface 600 as described above. Therefore, the above fluctuation of the tension of the second printing tape 403 and the sagging of the second printing tape 403 are prevented. Accordingly, it is possible to properly supply the second printing tape 403 that has been fed out from the tape roll 401 to the tape printing device 1.

(Other Modified Examples)

Besides the above embodiments, various configurations are adoptable without departing from the spirit as a matter of course. For example, the above embodiments are capable of being modified into the following modes.

The tape supplying device 501 may be configured to have both a non-installation mode in which the second printing tape 403 is supplied to the tape printing device 1 in a state in which the tape supplying device 501 is not installed on the tape printing device 1 and an installation mode in which the second printing tape 403 is supplied to the tape printing device 1 in a state in which the tape supplying device 501 is installed on the tape printing device 1. For example, in order to use both the modes for different purposes, the tape supplying device 501 may supply the second printing tape 403 to the tape printing device 1 under the installation mode when the tape roll 401 has a winding diameter smaller than that of the roll supporting part 503 and supply the second printing tape 403 to the tape printing device 1 under the non-installation mode to avoid the interference between the tape roll 401 and the tape printing device 1 when the tape roll 401 has a winding diameter larger than that of the roll supporting part 503. The shape of the pedestal part 505 is not limited to a substantially short cylindrical shape. For example, the pedestal part 505 may have a prism shape, a cone shape, or a shape in which these shapes are combined together. Further, in order to respond to a case in which the tape supplying device 501 is mounted on a mounting surface different from a mounting surface on which the tape printing device 1 is mounted, the pedestal part 505 may have an adjustment mechanism that adjusts a height at which the roll supporting part 503 is supported.

Cartridges are not limited to those having a configuration in which a printing tape or an ink ribbon is accommodated such as the tape cartridge 101 and the ribbon cartridge 201 of the present embodiment, but may only be required to have a configuration that allows the cartridges to be installed in the tape printing device 1.

The cartridge installation part 7 of the tape printing device 1 is not limited to a configuration in which the tape cartridge 101 and the ribbon cartridge 201 are alternatively installed but may have a configuration in which only the ribbon cartridge 201 is installed.

Further, the tape printing device 1 and the tape supplying device 501 may have a configuration in which the above embodiments and the modified examples are combined together.

(Supplementary Notes)

Hereinafter, a tape supplying device and a printing system will be supplementally noted.

A tape supplying device that supplies a printing tape from a tape roll having the printing tape wound therein to a tape printing device, the tape supplying device including: a roll supporting part that supports the tape roll in a posture in which a rotation axis of the tape roll crosses a mounting surface on which the tape printing device and the tape supplying device are mounted, wherein the tape supplying device supplies the printing tape to the tape printing device in a state in which the tape supplying device is not installed on the tape printing device.

According to the configuration, the tape roll is supported in a posture in which the rotation axis of the tape roll crosses the mounting surface. Therefore, it is possible to properly set the tape roll on the roll supporting part without interfering with the mounting surface even if the tape roll has a large winding diameter. Further, the printing tape is supplied to the tape printing device in a state in which the tape supplying device is not installed on the tape printing device. Therefore, a user is allowed to mount the tape supplying device at any place with respect to the tape printing device. Therefore, even if the tape roll has a large winding diameter, it is possible to properly set the tape roll on the roll supporting part without interfering with the tape printing device by mounting the tape supplying device at a place distant from the tape printing device.

In this case, the tape supplying device preferably further includes a pedestal part that rotatably supports the roll supporting part.

According to the configuration, the printing tape is smoothly fed out from the tape roll.

A tape printing system including: a tape printing device; and a tape supplying device that supplies a printing tape from a tape roll having the printing tape wound therein to a tape printing device, wherein the tape supplying device includes a roll supporting part that supports the tape roll in a posture in which a rotation axis of the tape roll crosses a mounting surface on which the tape printing device and the tape supplying device are mounted, and supplies the printing tape to the tape printing device in a state in which the tape supplying device is not installed on the tape printing device.

According to the configuration, the tape roll is supported in a posture in which the rotation axis of the tape roll crosses the mounting surface. Therefore, it is possible to properly set the tape roll on the roll supporting part without interfering with the mounting surface even if the tape roll has a large winding diameter. Further, the printing tape is supplied to the tape printing device in a state in which the tape supplying device is not installed on the tape printing device. Therefore, the user is allowed to mount the tape supplying device at any place with respect to the tape printing device. Therefore, even if the tape roll has a large winding diameter, it is possible to properly set the tape roll on the roll supporting part without interfering with the tape printing device by mounting the tape supplying device at a place distant from the tape printing device.

In this case, the tape printing device preferably includes a cartridge installation part in which a cartridge is installed, the cartridge preferably includes a platen roller and a tape path into which the printing tape fed out from the tape roll is introduced before the cartridge is installed in the cartridge installation part, the cartridge installation part preferably has a platen shaft that is inserted into the platen roller when the cartridge is installed, and the platen shaft preferably extends in a direction crossing the mounting surface.

According to the configuration, when the user installs the cartridge, in which the printing tape is set in advance in the tape path, in the cartridge installation part after setting the tape roll on the roll supporting part, it is possible to prevent the printing tape from twisting between the tape roll and the cartridge.

What is claimed is:

1. A tape printing system, comprising:

a tape printing device; and a tape supplying device that supplies a printing tape from a tape roll having the printing tape wound therein to the tape printing device, wherein the tape supplying device includes a roll supporting part that includes a cylindrical part and a flange part, wherein the cylindrical part is at a center of the roll supporting part, the flange part expands outside in a radial direction of the cylindrical part, the flange part is expanded from an intermediate part that is in an axial direction of the cylindrical part, the tape roll is on the flange part in a posture in which a rotation axis of the tape roll crosses a mounting surface on which the tape printing device and the tape supplying device are mounted, the tape roll is on the flange part in the posture in which one end surface of the tape roll comes in direct contact with a specific side surface of the flange part, and the mounting surface is perpendicular to a gravity direction, supplies the printing tape to the tape printing device in a state in which the tape supplying device is not installed on the tape printing device, and includes a pedestal part that rotatably support the roll supporting part, wherein the tape printing device includes a cartridge installation part in which a cartridge is installed, the cartridge includes a platen roller and a tape path into which the printing tape fed out from the tape roll is introduced before the cartridge is installed in the cartridge installation part, the cartridge installation part has a platen shaft that is inserted into the platen roller when the cartridge is installed, and the platen shaft extends in a direction crossing the mounting surface.

2. A tape printing system, comprising:

a tape printing device; and a tape supplying device that supplies a printing tape from a tape roll having the printing tape wound therein to the tape printing device, wherein the tape printing device includes a cartridge installation part in which a cartridge is installed, the cartridge includes a platen roller and a tape path into which the printing tape fed out from the tape roll is introduced before the cartridge is installed in the cartridge installation part, the cartridge installation part has a platen shaft that is inserted into the platen roller when the cartridge is installed, the platen shaft extends in a direction crossing a mounting surface on which the tape printing device and the tape supplying device are mounted, the tape supplying device includes a roll supporting part that supports the tape roll in a posture in which a rotation axis of the tape roll crosses the mounting surface, and supplies the printing tape to the tape printing device in a state in which the tape supplying device is not installed on the tape printing device.

* * * * *